US008365661B2

(12) United States Patent
Maschler

(10) Patent No.: US 8,365,661 B2
(45) Date of Patent: Feb. 5, 2013

(54) PRINTING PRESS FOR PRINTING ON BOTH SIDES OF SHEETS

(75) Inventor: Ernst-Christian Maschler, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 552 days.

(21) Appl. No.: 12/581,470

(22) Filed: Oct. 19, 2009

(65) Prior Publication Data

US 2010/0095861 A1 Apr. 22, 2010

(30) Foreign Application Priority Data

Oct. 17, 2008 (DE) ..... 10 2008 052 181

(51) Int. Cl.
*B41F 5/02* (2006.01)

(52) U.S. Cl. ..... 101/230; 101/183; 101/409

(58) Field of Classification Search ..... 101/183, 101/184, 229, 230, 408, 409
See application file for complete search history.

(56) References Cited

U.S. PATENT DOCUMENTS

| | | | | |
|---|---|---|---|---|
| 1,864,192 | A * | 6/1932 | Fischer | 101/157 |
| 5,555,804 | A | 9/1996 | Kojima | |
| 5,873,309 | A * | 2/1999 | Mack et al. | 101/424.1 |
| 6,293,193 | B1 | 9/2001 | Bolza-Schunemann | |
| 7,735,418 | B2 * | 6/2010 | Hoffmann et al. | 101/180 |

FOREIGN PATENT DOCUMENTS

| | | | |
|---|---|---|---|
| DE | 2639900 | A1 | 5/1977 |
| DE | 4422390 | A1 | 1/1995 |
| DE | 19756796 | A1 | 7/1999 |
| DE | 19756990 | A1 | 7/1999 |
| DE | 69809677 | T2 | 9/2003 |
| GB | 1514108 | A | 6/1978 |
| JP | 11300924 | A | 11/1999 |

OTHER PUBLICATIONS

Machine English Translation of JP 11-300924, Nov. 1999.*
German Search Report dated Aug. 27, 2009.

* cited by examiner

*Primary Examiner* — Ren Yan
(74) *Attorney, Agent, or Firm* — Laurence A. Greenberg; Werner H. Stemer; Ralph E. Locher

(57) ABSTRACT

A printing press for printing on both sides of sheets is developed with low expenditure on costs and material, makes it possible to print on both sides of sheets in one pass and which has a small overall size. The printing press for printing on both sides of sheets, has at least one printing unit, in which in each case at least one form cylinder and at least one sheet-guiding impression cylinder are provided. A feeder feeds sheets individually one after another to the printing unit. A delivery guides the sheets away from the printing unit, and grippers convey the sheets individually one after another along a path which runs back and forth, the paths crossing one another.

5 Claims, 6 Drawing Sheets

PRINTING PRESS FOR PRINTING ON BOTH SIDES OF SHEETS

CROSS-REFERENCE TO RELATED APPLICATION

This application claims the priority, under 35 U.S.C. §119, of German application DE 10 2008 052 181.7, filed Oct. 17, 2008; the prior application is herewith incorporated by reference in its entirety.

BACKGROUND OF THE INVENTION

Field of the Invention

The invention relates to a printing press for printing on both sides of sheets. The printing press has at least one printing unit, in which in each case at least one form cylinder and at least one sheet-guiding impression cylinder are provided. A feeder feeds sheets individually one after another to the printing unit. A delivery guides the sheets away from the printing unit, and grippers convey the sheets individually one after another along a path which runs back and forth.

Conventional sheet-fed printing presses contain a plurality of printing units of the same type which are arranged horizontally next to one another in a row. Here, sheets are separated from a stack in a feeder and are fed to a first recto printing unit. In the sheet run, a last recto printing unit is followed by a turner apparatus and a row of verso printing units. A delivery, in which the finished sheets are conveyed onto a stack, is arranged after a last verso printing unit. A turner apparatus contains a multiplicity of machine elements which work and tumble or turn over a sheet. The turner apparatus increases the overall size of the printing press. A printing press according to published, non-prosecuted German patent application DE 26 39 900 A1 contains a module having a turner apparatus and a dryer. The length of the machine is increased by the module length.

Furthermore, printing presses are known which make it possible to print sheets on both sides without special turner apparatuses.

In a sheet-fed printing press according to published, non-prosecuted German patent application DE 197 56 796 A1, the sheets are printed in two passes, a feeder stack and a delivery stack being arranged on one and the same side of the machine. The machine time is more than doubled by the sheets being fed through twice.

Published, non-prosecuted German patent application DE 197 56 990 A1 describes a double-sided printing press, in which there are two ink transport paths in each printing unit. A rubber-covered cylinder of a double printing unit is configured as a sheet-guiding cylinder. The feeder and delivery are situated on different sides of the printing press. The ink transport paths are configured differently vertically downward and upward, in each case according to the ink flow. The printing zones are formed in each case between two rubber-covered cylinders.

Japanese patent application JP 11-300924 A discloses a sheet-fed printing press having a feeder, a plurality of double printing units of inline construction, a turner apparatus and a delivery. The feeder and delivery lie on the same side of the printing press. The double printing units contain in each case one impression cylinder which lies in one horizontal plane with an adjacent impression cylinder. The sheets run along a first path from the feeder to a turner apparatus and along a separate second path from the turner apparatus back to the delivery. The turner apparatus works and tumbles a sheet by way of three drums. The turner apparatus increases the overall size of the machine. The inking and dampening units which are provided below the plane differ from those above the plane on account of the vertical ink flow direction.

SUMMARY OF THE INVENTION

It is accordingly an object of the invention to provide a printing press for printing on both sides of sheets which overcomes the above-mentioned disadvantages of the prior art devices of this general type, which has low expenditure on costs and material, makes printing possible on both sides of sheets in one pass, and has a low overall size.

With the foregoing and other objects in view there is provided, in accordance with the invention a printing press for printing on both sides of sheets. The printing press has at least one printing unit with in each case at least one form cylinder and at least one sheet-guiding impression cylinder. A feeder feeds the sheets individually one after another to the printing unit. A delivery guides the sheets away from the printing unit and grippers convey the sheets individually one after another along paths which run back and forth and cross one another.

According to the invention, the sheets run through paths which cross one another. The movement direction of the sheets is reversed at the end of an outward path, at least one sheet-guiding cylinder guiding a sheet both in the outward path and in the return path.

In one preferred variant, the printing press contains at least one printing unit having an impression cylinder, the effective diameter of which is at least twice as large as a form cylinder which is assigned to the impression cylinder. One sheet is fed in with every revolution of the impression cylinder. This produces gaps between the sheets which run through, through which gaps the returning sheets are conveyed. A reflector drum is situated at the end of the outward path, which reflector drum causes a sheet at the last impression cylinder of the outward path to be moved by the circumferential face in a first semicylindrical sector into the circumferential face of the second semicylindrical sector. Only half of the impression cylinders interacts with an adjacent transfer cylinder. The respective second half acts as a pure sheet-guiding half without printing function. This prevents printing ink being transferred onto the sheet-guiding half if no sheet is being conveyed on the half. The double-sized impression cylinders have in each case two diametric gripper systems, the grippers of the first gripper system being used only for conveying in the outward path and the grippers of the second gripper system being used only for conveying in the return path. If a plurality of printing units are arranged next to one another, the printing units for printing on the front side and the rear side of the sheets are arranged alternately next to one another.

Other features which are considered as characteristic for the invention are set forth in the appended claims.

Although the invention is illustrated and described herein as embodied in a printing press for printing on both sides of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
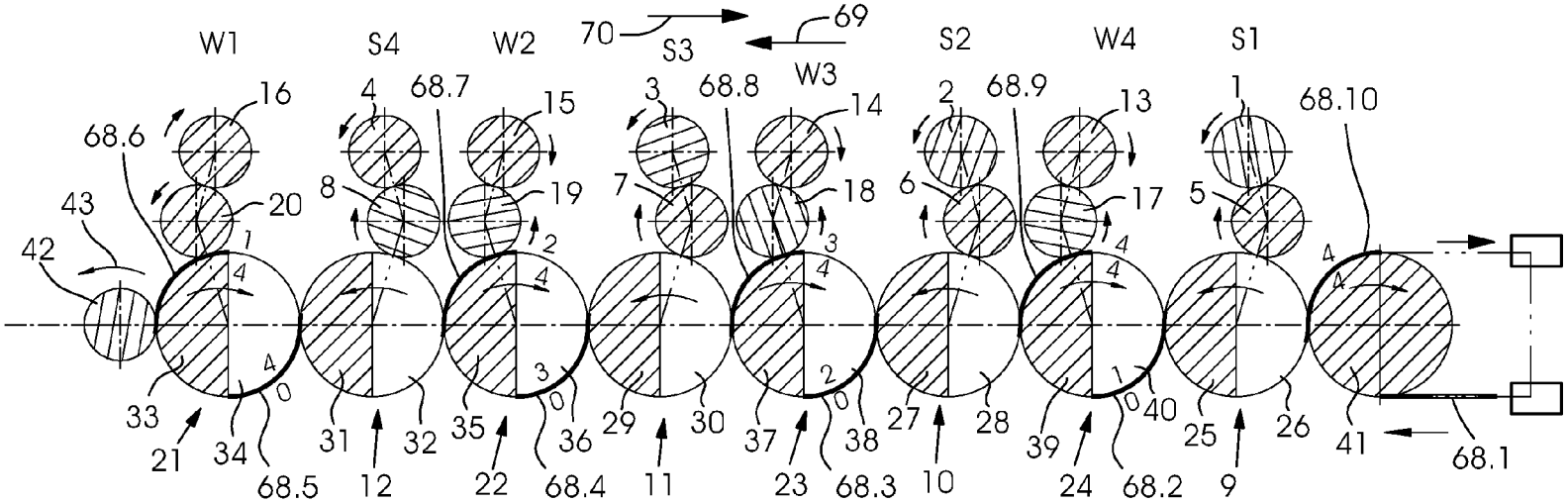
FIGS. 1A-1D are diagrammatic side views of a printing press in four printing phases according to the invention.

Referring now to the figures of the drawing in detail and first, particularly, to FIGS. 1A-1D thereof, there is shown an offset printing press, by way of which it is possible to print sheets in four colors on both sides in one pass. The printing press contains four recto printing units S1-S4 and four verso printing units W1-W4. The recto printing units S1-S4 in each case contain a form cylinder 1-4, a transfer cylinder 5-8 and an impression cylinder 9-12. The verso printing units W1-W4 in each case contain a form cylinder 13-16, a transfer cylinder 17-20 and an impression cylinder 21-24. Each printing unit S1-S4, W1-W4 contains, furthermore, an inking unit and a dampening unit which are assigned in each case to the form cylinders 1-4, 13-16. The form cylinders 1-4, 13-16 in each case carry a wet offset printing form. An elastic cover is pulled in each case onto the transfer cylinders 5-8, 17-20, by way of which elastic cover printing ink is transferred from the printing forms onto a sheet which is being conveyed on the respective impression cylinder 9-12, 21-24. Each impression cylinder 9-12, 21-24 has two semicylindrical sectors 25-40. The hatched sectors 25, 27, 29, 31, 33, 35, 37, 39 have a circumferential face which carries a sheet. The impression cylinders 9-12, 21-24 do not have a surface which builds up a pressure in the sectors 26, 28, 30, 32, 34, 36, 38, 40 which are not hatched. Gripper systems for holding a sheet at the leading edge are situated diametrally in all the sectors 25-40. The impression cylinder 9 is assigned a transfer drum 41 which likewise has diametral gripper systems. The impression cylinder 21 is assigned a reflector drum 42, on which a gripper system is arranged. The active diameters of the impression cylinders 9-12, 21-24 and of the transfer drum 41 are twice as large as the diameters of the form cylinders 1-4, 13-16, of the transfer cylinders 5-8, 17-20 and of the reflector drum 42. All the cylinders 1-24 and drums 41, 42 are mounted rotatably in side walls of the printing press and can be driven synchronously in the direction of the arrows 43 by gearwheel mechanisms and/or individual drives. The rotational axes 44-53 of the impression cylinders 9-12, 21-24 and of the drums 41, 42 lie in a horizontal plane 54. The grippers of the gripper systems of the impression cylinders 9-12, 21-24 and of the drums 41, 42 run on circular paths which are tangent in transfer lines 55-63. Transfer lines 64, 65 are situated below and above an axis 52 of the transfer drum 41, in which transfer lines 64, 65 a sheet is transferred from a feeder 66 to a gripper system of the transfer drum 41 or from a gripper system of the transfer drum 41 to a delivery 67.

FIGS. 1A-1D show the printing press in four phases, in which in each case the impression cylinders 9-12, 21-24 and the transfer drum 41 are rotated further by 90°. The numbers on both sides of sheets 68 denote in each case the number of color separations which are printed over one another on the respective side.

According to FIG. 1A, an unprinted sheet 68.1 is separated from a stack in the feeder and fed to a gripper system of the transfer drum 41. Further preceding sheets 68.2-68.5 are conveyed on the impression cylinders 24, 23, 22, 21 in the sectors 40, 38, 36, 34. As viewed from the location of the feeder 66 and delivery 67, the sheets 68.1-68.5 are conveyed in a first direction 69 to the reflector drum 42. At the same time, sheets 68.6-68.10 run back to the delivery 67 in the opposite direction 70. The front edge of the sheet 68.10 is situated in the transfer line 65.

Figure 2:
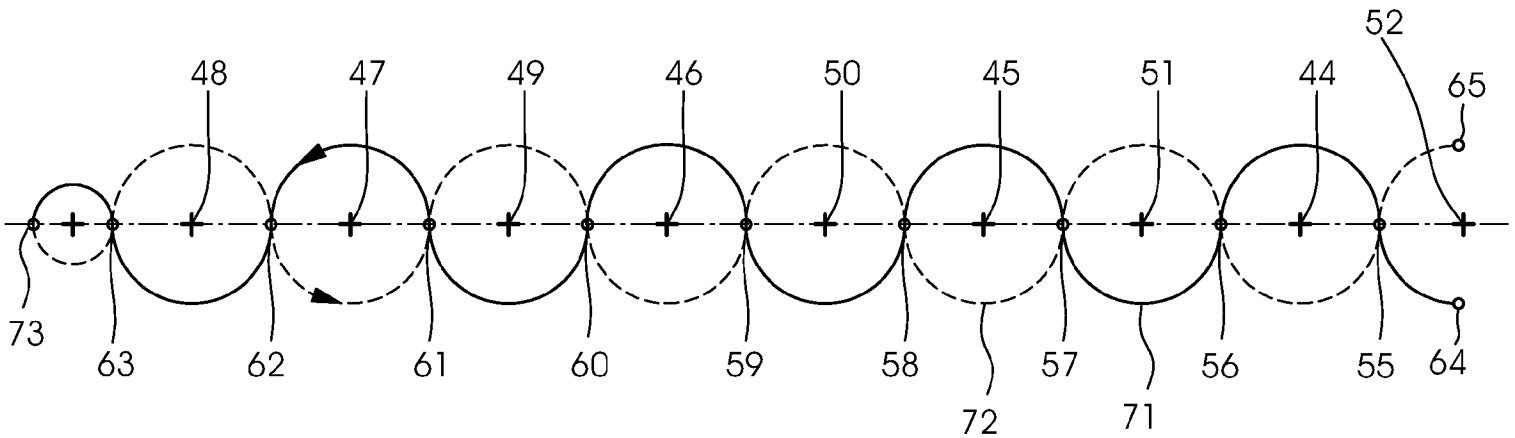
FIG. 2 is an illustration of an outward path and a return path.

On the way from the feeder 66 to the reflector drum 42 and back to the delivery 67, the sheets 68 run through two different paths 71, 72 which, as shown in FIG. 2, cross one another in the transfer lines 55-63. In the transfer line 63, in each case one sheet 68 in the outward path 71 is received by the reflector drum 42 and guided around in a circular path. Here, the sheet 68 runs through a reversing point 73. After the reversing point 73, the sheets 68 are conveyed in the return path 72 which is illustrated by way of a dashed line. In the outward path 71, the sheets 68 receive prints on the front side in the printing units S1-S4. In the return path 72, the sheets 68 are printed on the rear side in the printing units W1-W4. Before being transported back by way of the impression cylinder 21, the prints on the front side can be dried by way of at least one dryer. In the paths 71, 72, the sheets 68 are conveyed on circular tracks which result from the movement of the gripper systems. In the transfer lines 55-63, sheet transfers take place in each case from an impression cylinder to an adjacent impression cylinder or to a drum.

Figure 1B:
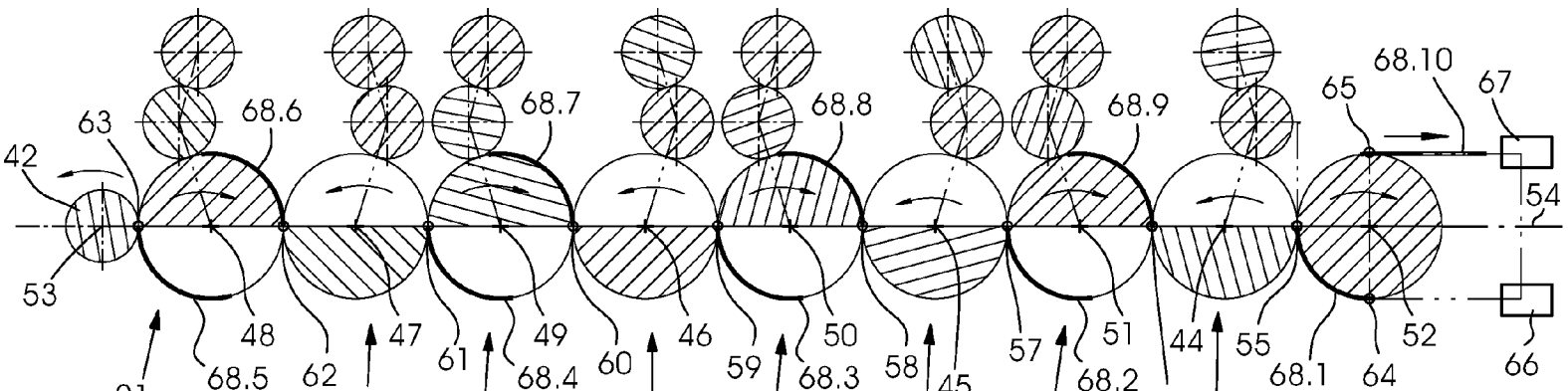

FIG. 1B shows a phase in which the sheet 68.1 is transferred from the transfer drum 41 to the impression cylinder 9. In each case in the outward path 71, the sheets 68.2-68.4 are transferred from the impression cylinders 24, 23, 22 to the adjacent impression cylinders 10, 11, 12. In the transfer line 63, the sheet 68.5 passes from the impression cylinder 21 onto the reflector drum 42. In the return path 72, the sheets 68.6-68.9 are transferred from the impression cylinders 21, 22, 23, 24 to the adjacent impression cylinders 12, 11, 10, 9. The sheet 68.10 leaves the printing press and is conveyed onto a stack by the delivery 67.

Figure 1C:
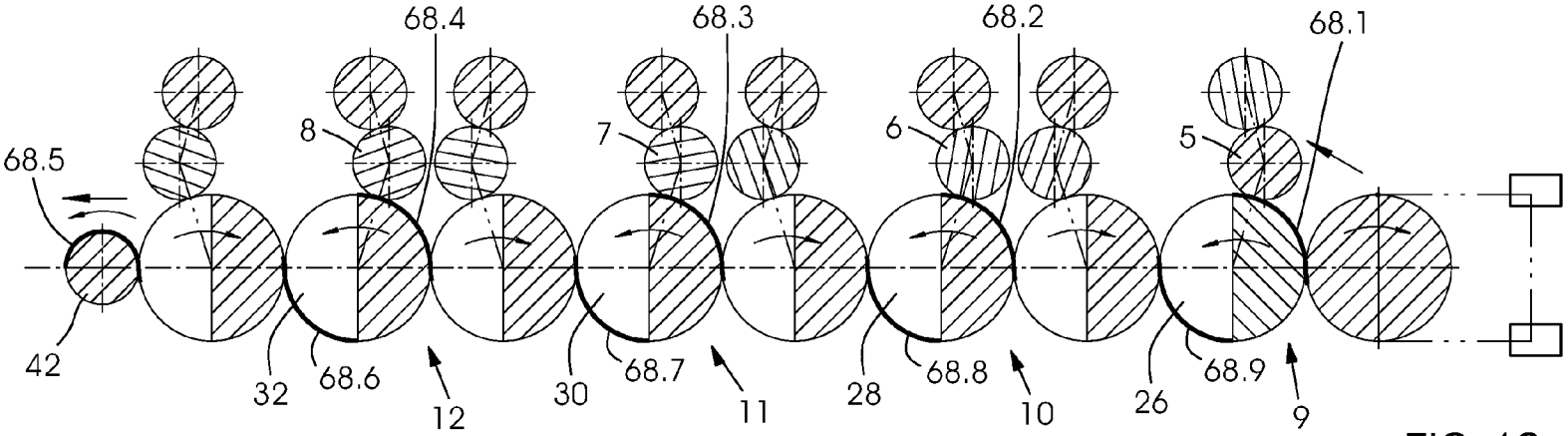

A further 90° rotation of the impression cylinders 9-12, 21-24 results in the phase position which is shown in FIG. 1C. Accordingly, the sheets 68.1-68.4 are printed on the front side in the outward path 71 in each case in the nip between the impression cylinders 9-12 and the transfer cylinders 5-8. The sheet 68.5 is guided around on the reflector drum 42. In the return path 72, the sheets 68.6-68.9 are conveyed in the non-printing sectors 32, 30, 28, 26 of the impression cylinders 12, 11, 10, 9.

Figure 1D:
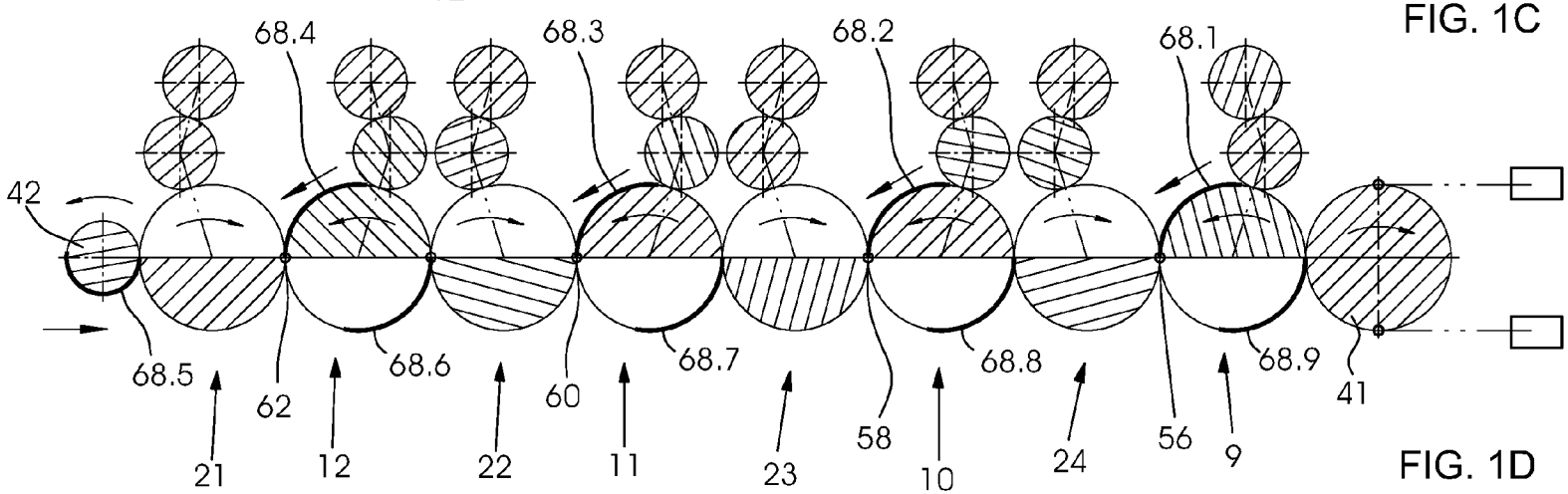

In accordance with the phase position according to FIG. 1D, the sheets 68.1-68.4 in the outward path 71 are transferred in the transfer lines 56, 58, 60, 62 from the impression cylinders 9-12 to the impression cylinders 24, 23, 22, 21. The sheet 68.5 is guided in the return path 72 by the reflector drum 42. Furthermore, in the return path 72, the sheets 68.6-68.9 are transferred from the impression cylinders 12, 11, 10, 9 to the respectively adjacent impression cylinder 22-25 or to the transfer drum 41.

The invention is not restricted to the cylinder configuration which is described in FIGS. 1A-1D. For example, quadruple-sized impression cylinders can be provided instead of the double-sized impression cylinders 9-12, 21-24. Furthermore, the transfer drums can be provided behind every second impression cylinder, in order to obtain greater clearance for service purposes between the printing units.

Figure 3:
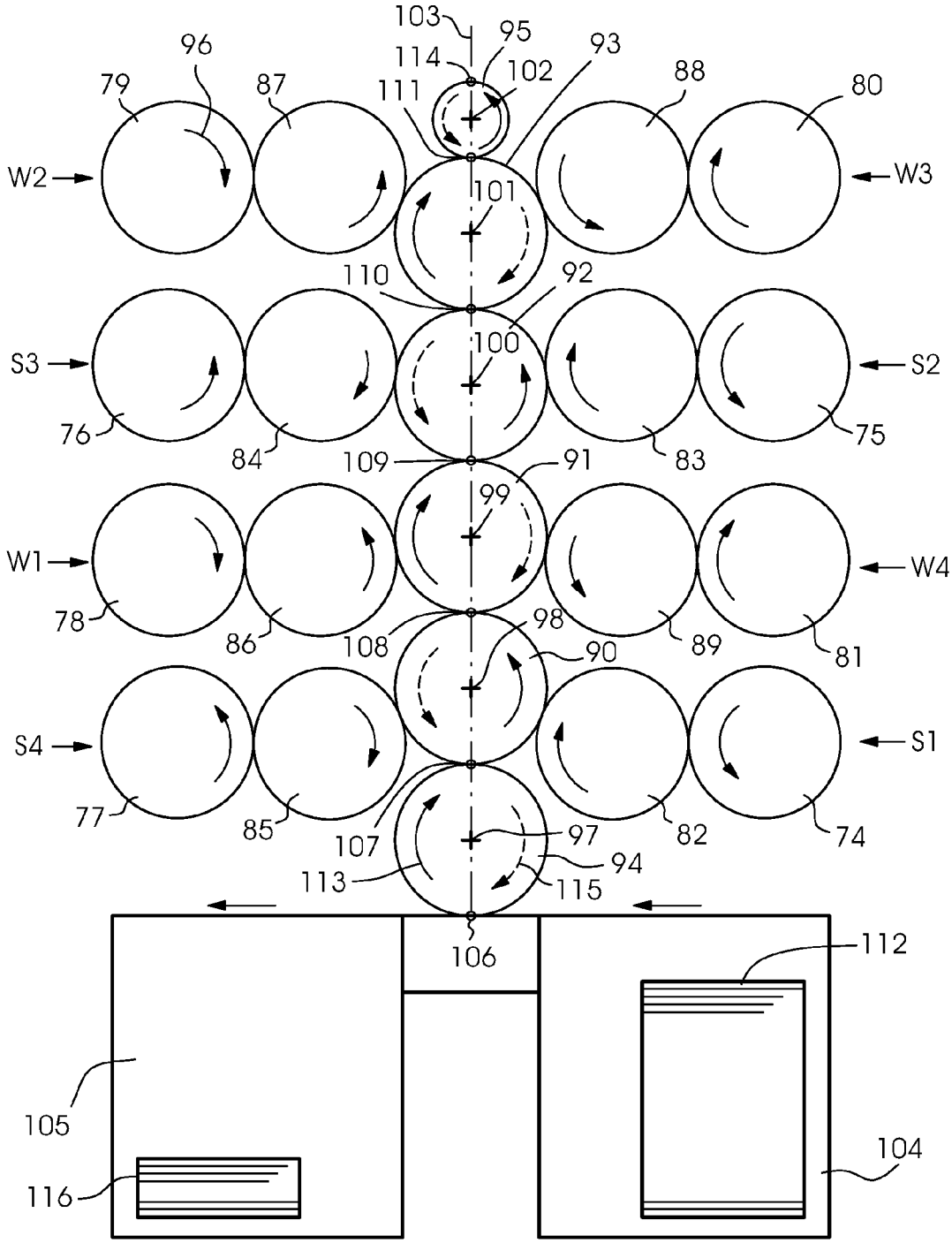
FIG. 3 is a diagram of the printing press having printing units which are disposed vertically above one another and a separate reflector drum.

FIG. 3 shows one exemplary embodiment having the recto printing units S1-S4 and the verso printing units W1-W4 which are arranged vertically above one another. Each printing unit S1-S4, W1-W4 contains, inter alia, a form cylinder 74-81 and a transfer cylinder 82-89. The printing units S1, S4; W1, W4; S2, S3 and W2, W3 have common impression cylinders 90-93. The impression cylinder 90 is assigned a transfer drum 94. The impression cylinder 93 is assigned a reflector drum 95. The form cylinders 74-81, the transfer cylinders 82-89, the impression cylinders 90-93 and the transfer drum 94 are configured with twice as large a diameter as the reflector drum 95. The form cylinders 74-81 carry a printing form of a color separation. The transfer cylinders 82-89 are provided with elastic covers. In each case one gripper system for holding a sheet at the leading edge is arranged on the impression cylinders 90-93. All the cylinders 74-93 and drums 94, 95 are mounted in side walls of the printing press and can be driven in the direction of the arrows 96 by gearwheel mechanisms and/or individual drives. The rotational axes 97-102 of the transfer drum 94, the impression cylinders 90-93 and the reflector drum 95 lie in a vertical plane 103. The cylinders 74-89 of the printing units S1-S4, W1-W4 lie symmetrically with respect to the plane 103. A feeder 104 and a delivery 105 are arranged below the transfer drum 94. The transfer drum 94, the impression cylinders 90-93 and the reflector drum 95 are equipped with gripper systems which make it possible to transfer sheets in each case in a transfer line 106-111.

During printing, sheets 112 are separated in the feeder 104 and are fed one after another to the transfer drum 94. In the transfer line 106, in each case one sheet 112 is received by a gripper system of the transfer drum 94. Starting from the transfer line 106, the sheets 112 are conveyed along a first path in the direction of the reflector drum 95. The sheets 112 are transferred one after another from the transfer drum 94 to the impression cylinders 90-93. The first path is illustrated symbolically by solid arrows 113 in the transfer drum 94, the impression cylinders 90-93 and the reflector drum 95. At the end of the first path, a sheet 112 reaches a reversing point 114. The sheets 112 are conveyed back in the direction of the transfer line 106 on a second path by the reflector drum 94. The second path is illustrated symbolically by dashed arrows 115. Both paths contain semicircles which are strung together and lie symmetrically with respect to the plane 103. The paths cross one another in the transfer lines 106-111. At the end of the return path, the sheets 112 are transferred to a gripper system of the delivery 105 in the transfer line 106. In the delivery 105, the sheets 112 are deposited onto a stack 116.

Figure 4:
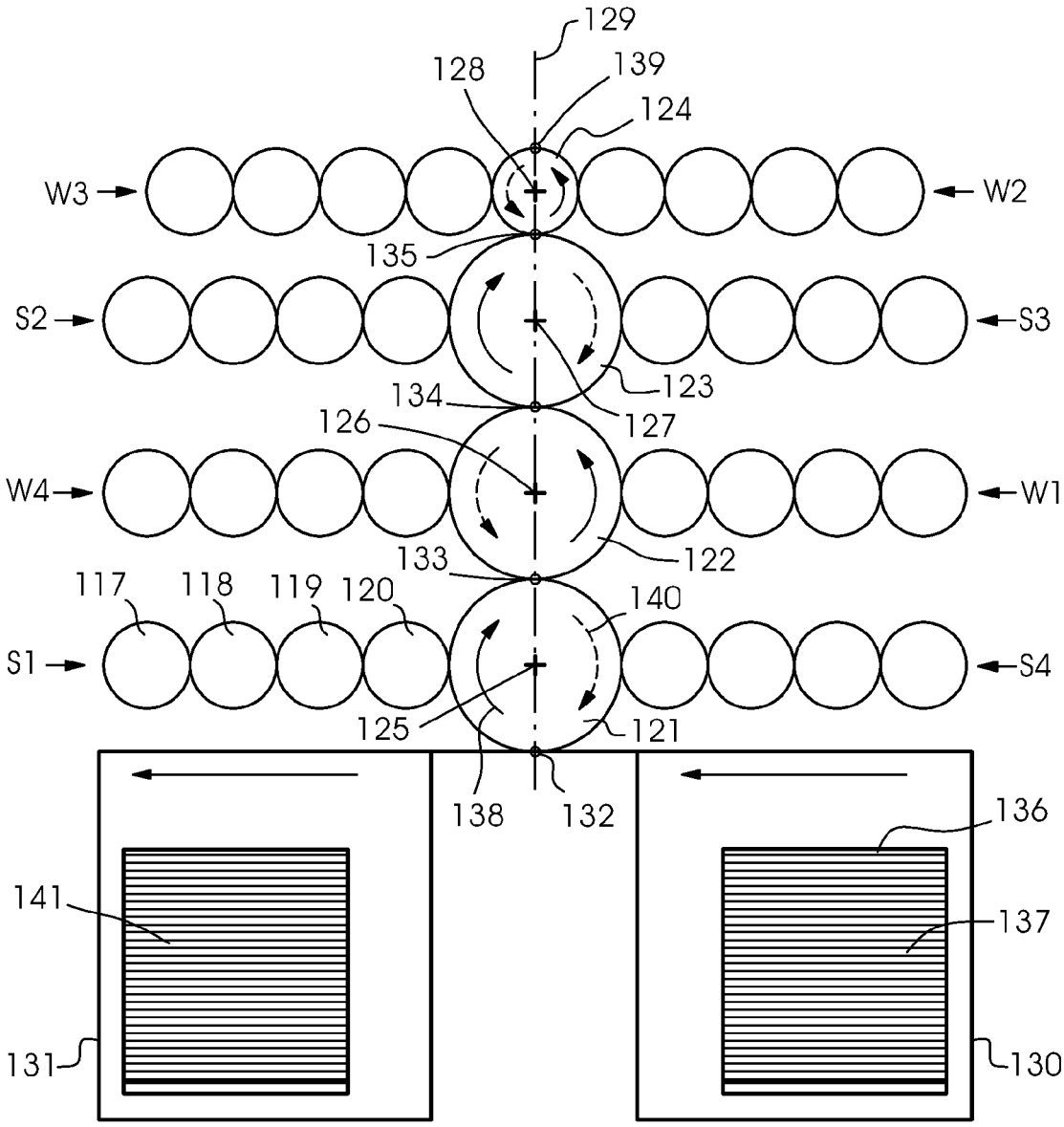
FIG. 4 is a diagram of the printing press having printing units which are disposed vertically above one another without a separate reflector drum.

A printing press according to FIG. 4 contains four recto printing units S1-S4 and four verso printing units W1-W4. Each printing unit S1-S4, W1-W4 contains an engraved roller 117 of a short inking unit, an ink applicator roller 118, a form cylinder 119 and a transfer cylinder 120. The transfer cylinders 120 of the printing units S1 and S4, W1 and W4, S2 and S3, and W2 and W3 interact with common impression cylinders 121-124. The rotational axes 125-128 of the impression cylinders 121-124 lie in a vertical plane 129. The diameters of the impression cylinders 121-123 are twice as large as the diameters of the impression cylinder 124, the form cylinder 119 and the transfer cylinder 120. The impression cylinder 121 is assigned a feeder 130 and a delivery 131. There are transfer lines 132-135 below the impression cylinder 121 and between the impression cylinders 121, 122; 122, 123; 123, 124.

During printing, the sheets 136 are separated from a stack 137 and are transferred to the impression cylinder 121 in the transfer line 132. Starting from the transfer line 132, the sheets 136 run through an outward path and a return path in the manner of a slalom. The outward path is illustrated symbolically by way of solid arrows 138. The outward path ends at a reversing point 139 in the track course on the impression cylinder 124. The impression cylinder 124 acts as a reflector drum. The sheets 136 are guided around on the impression cylinder 124 from the outward path into the return path. The return path is illustrated by way of dashed arrows 140. The outward path and return path cross one another in the transfer lines 132-135 and lie symmetrically with respect to the plane 129. At the end of the return path, the sheets 136 are transferred to a gripper system of the delivery 131 in the transfer line 132 and are deposited onto a stack 141.

Figure 5:
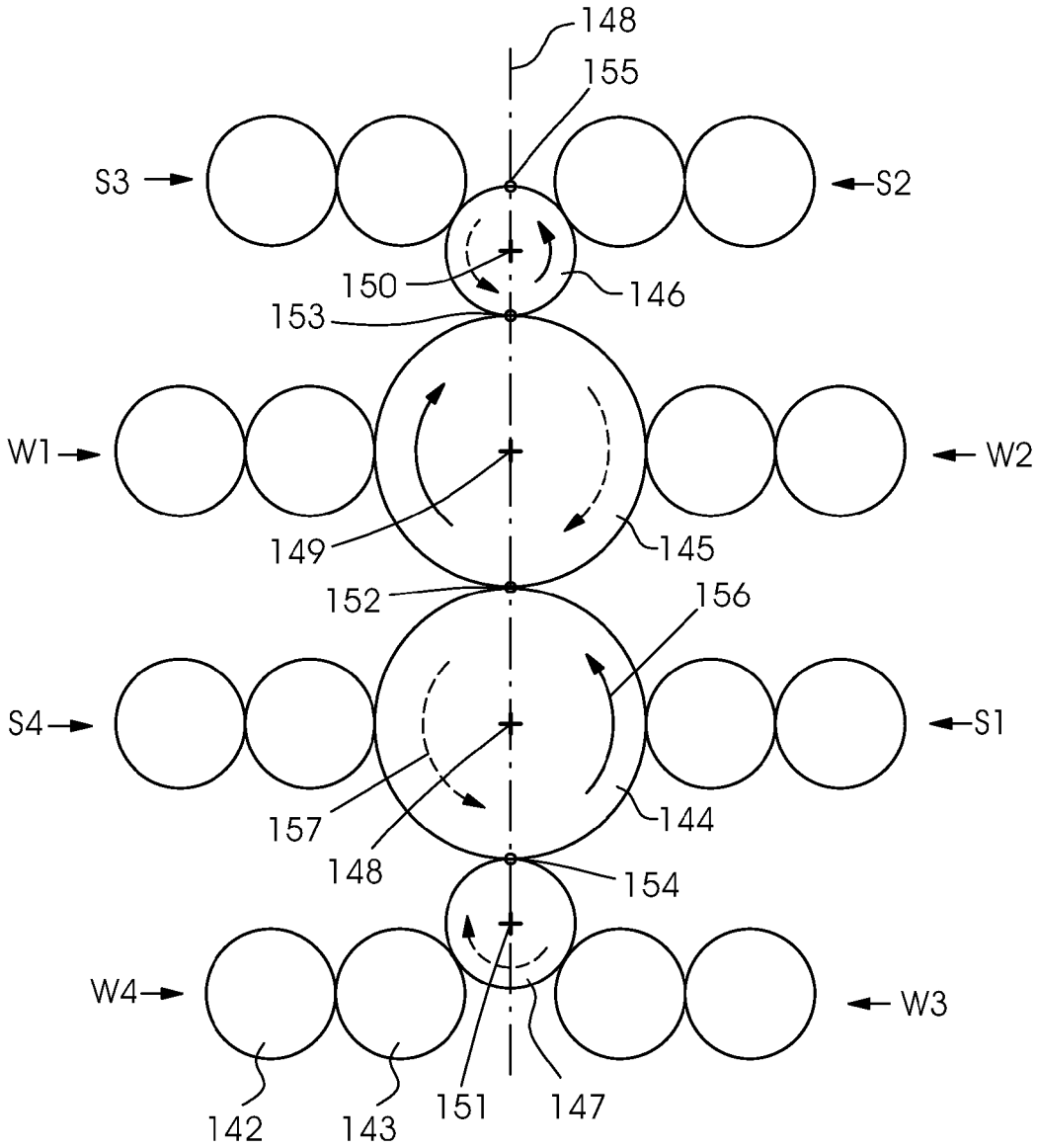
FIG. 5 is a diagram of the printing press with a flexible arrangement of feeder and delivery.

FIG. 5 shows a further variant having recto printing units S1-S4 and verso printing units W1-W4 which are arranged vertically above one another. The printing units S1-S4, W1-W4 contain in each case, inter alia, a form cylinder 142 and a transfer cylinder 143. The printing units 51, S4; W1, W2; S2, S3 and W3, W4 interact in each case with common impression cylinders 144-147. The rotational axes 148-151 of the impression cylinders 144-147 lie in a vertical plane 148. There are transfer lines 152-154 between the impression cylinders 144, 145; 145, 146 and 144, 147. During printing, the sheets are fed individually one after another from a feeder to the impression cylinder 144. The sheets run through a first path with the transfer lines 154, 152, 153 and receive prints one after another in the printing units S1, W1, S2. The impression cylinder 146 acts as a reflector drum. From a reversing point 155, the sheets run back to the transfer line 154 in a second path. The first and second paths are illustrated symbolically by solid and dashed arrows 156, 157. In the second path, the sheets receive prints one after another in the printing units S3, W2 and S4. The zigzag-shaped paths cross one another in the transfer lines 152-154. In the transfer line 154, the sheets are transferred further to the impression cylinder 147. During the conveying on the impression cylinder 147, the sheets receive prints one after another in the printing units W3 and W4. After the application of the final print on the rear side of the sheets in the printing unit W4, the sheets pass into the transfer line 154 again and are transferred to a gripper system of a delivery. The variant according to FIG. 5 shows that, in the context of the invention, the sheets can be fed in and guided away at any desired location of the printing press. In every case, the sheets run through at least one outward and one return slaloming path, which paths cross one another.

The invention claimed is:

1. A printing press for printing on both sides of sheets, comprising:

at least four printing units having in each case a transfer cylinder for guiding printing ink, one form cylinder and only one sheet-guiding impression cylinder, said impression cylinders of said printing units being adjacent to one another, said form cylinders having axes disposed above a plane in which axes of said impression cylinders lie;

each of said impression cylinders having respective grippers for conveying the sheets individually one after another directly from one said impression cylinder to an adjacent said impression cylinder forth and back along an outward path and a return path which cross one another multiple times between said adjacent impression cylinders, said impression cylinders each having a respective first circumferential face carrying the sheets and interacting with said transfer cylinder in a first semicylindrical sector, and a respective second circumferential face carrying the sheets in a second semicylindrical sector.

2. The printing press according to claim 1, wherein the sheets can be fed after every second revolution of said form cylinder.

3. The printing press according to claim 1, further comprising a reflector drum disposed at an end of said outward path and at a start of said return path.

4. A printing press for printing on both sides of sheets, comprising:

at least four printing units having in each case a transfer cylinder for guiding printing ink, and at least one form cylinder, said at least four printing units having impression cylinders disposed along a vertical plane and being directly adjacent one another and each having respective grippers for conveying the sheets individually one after another directly from one said impression cylinder to an adjacent said impression cylinder along paths which cross one another multiple times on said impression cylinders, said impression cylinders each interacting with two of said transfer cylinders disposed on opposite sides of said vertical plane and having two of said form cylinders disposed on opposite sides of said vertical plane.

5. The printing press according to claim 4, wherein one of said impression cylinders is assigned a transfer drum and another of said impression cylinders is assigned a reflector drum.

* * * * *